US007818912B1

(12) United States Patent
Thomas

(10) Patent No.: US 7,818,912 B1
(45) Date of Patent: Oct. 26, 2010

(54) BREECH BOLT FOR MOUNTING A SIGHTING DEVICE THERETO

(76) Inventor: Guy Michael Thomas, 2603 E. 14th St., Tulsa, OK (US) 74104-4702

( * ) Notice: Subject to any disclaimer, the term of this patent is extended or adjusted under 35 U.S.C. 154(b) by 530 days.

(21) Appl. No.: 11/784,064

(22) Filed: Apr. 5, 2007

Related U.S. Application Data

(60) Provisional application No. 60/789,976, filed on Apr. 6, 2006.

(51) Int. Cl.
*F41G 1/387* (2006.01)

(52) U.S. Cl. ..... 42/124

(58) Field of Classification Search ..... 89/194; 42/124, 127, 128
See application file for complete search history.

(56) References Cited

U.S. PATENT DOCUMENTS 2,112,268 A * 3/1938 Burton ..... 42/138
3,153,856 A 10/1964 Felix
3,986,285 A 10/1976 Krisay
4,873,779 A 10/1989 Ellison et al.
5,428,915 A 7/1995 King
5,694,712 A 12/1997 Plonka
5,926,964 A 7/1999 Korapaty
6,421,946 B1 * 7/2002 LoRocco ..... 42/111
6,477,778 B1 11/2002 Lorocco
6,701,660 B2 3/2004 Stover

* cited by examiner

*Primary Examiner*—Stephen M Johnson
(74) *Attorney, Agent, or Firm*—William R. Sharp

(57) ABSTRACT

In a firearm of the type having an open-top receiver and a nonrotatable breech bolt longitudinally slidable therein between open and closed positions in which an upper portion of the breech bolt is exposed, the upper portion of the breech bolt is adapted to allow a sighting device to be fixedly but removably mounted thereto. The upper portion of the breech bolt preferably has a pair of longitudinally extending and transversely opposed grooves positioned above but closely adjacent to opposite sides of the receiver. One or more conventional mounting clamps can be employed to securely engage the grooves for mounting a sighting device to the bolt. The sighting device should be sufficiently short to ensure that ejected shell casings do not impact any part of the sighting device.

11 Claims, 2 Drawing Sheets

BREECH BOLT FOR MOUNTING A SIGHTING DEVICE THERETO

CROSS-REFERENCE TO RELATED APPLICATIONS

This application claims the benefit of U.S. Provisional Application No. 60/789,976, filed Apr. 6, 2006.

BACKGROUND OF THE INVENTION

The invention relates to the problem of mounting a sighting device to a top ejection firearm.

A top ejection firearm, such as the Winchester Model 94 rifle manufactured before about 1982, includes a receiver having an open top through which spent shell casings are ejected. Consequently, a sighting device cannot be mounted to the top of the receiver. A sighting device can be side mounted to the receiver, but this is generally undesirable in being horizontally offset from the line defined by the path of the bullet, thus requiring the shooter to assume an awkward and ineffective firing stance.

SUMMARY OF THE INVENTION

It is, therefore, an object of the invention to provide a means by which a sighting device can be top mounted to a top ejection firearm for optimum effectiveness and ease of use.

The above object is realized in a firearm of the type having an open-top receiver and a nonrotatable breech bolt longitudinally slidable therein between open and closed positions in which an upper portion of the breech bolt is exposed, the upper portion of the breech bolt being adapted to allow a sighting device to be fixedly but removably mounted thereto. The upper portion of the breech bolt preferably has a pair of longitudinally extending and transversely opposed grooves positioned above but closely adjacent to opposite sides of the receiver. One or more conventional mounting clamps can be employed to securely engage the grooves for mounting a sighting device to the bolt. As discussed further below, the sighting device should be sufficiently short to ensure that ejected sell casings do not impact any part of the sighting device.

DETAILED DESCRIPTION OF THE INVENTION

The embodiment of the invention described below is in the context of a Winchester Model 94 top ejection rifle. However, the invention can be applied to any top ejection firearm of the type previously described. All subsequent references to a "bolt" are understood to mean a breech bolt, as opposed to some other type of bolt, such as a locking bolt. In addition, and as used herein and in the appended claims, the term "sighting device" refers to a device for use with a firearm to assist in aiming at or finding the direction of a target.

Figure 1:
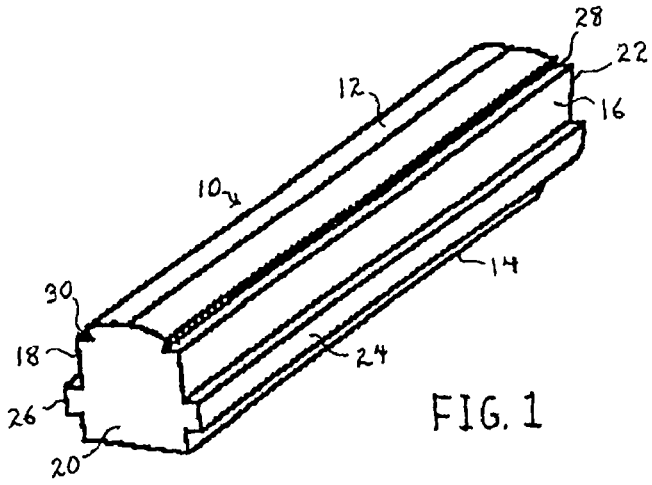
FIG. 1 is a perspective view of a breech bolt in accordance with one embodiment of the invention.

Referring to FIG. 1, the illustrated bolt 10 is an elongated metallic member having a slightly convex top face 12, a bottom face 14, opposing side faces 16 and 18, a front face 20, and a rear face 22. Of course, not all indicated faces are fully visible in FIG. 1. A pair of ribs 24 and 26 project outwardly from respective side faces 16 and 18 so as to longitudinally extend between front face 20 and rear face 22.

Bolt 10 further has a pair of dovetail grooves 28 and 30, of which only a front end portion of groove 30 is shown in FIG. 1. Grooves 28 and 30 longitudinally extend between front face 20 and rear face 22 along an upper portion of bolt 10, most preferably along where top face 12 joins opposing side faces 16 and 18. Grooves 28 and 30 are, therefore, transversely opposite one another. Although grooves 28 and 30 extend the entire length of bolt 10 in the illustrated embodiment, such grooves could stop somewhat short of the front or rear face, when necessary, without substantially affecting the intended function thereof. For example, some Model 94 bolts have a reduced width immediately adjacent to the front face, thereby preventing the formation of grooves in this area.

Bolt 10 is substantially conventional except for grooves 28 and 30. A conventional bolt can be easily modified by cutting the grooves therein with appropriate machining tools. Alternatively, bolt 10 could be newly manufactured to have the grooves. It should be understood that bolt 10 is illustrated in a somewhat simplified manner so as to omit parts associated with the bolt, such as the extractor, ejector, and internal firing pin, which are not directly pertinent to the invention.

Figure 2:
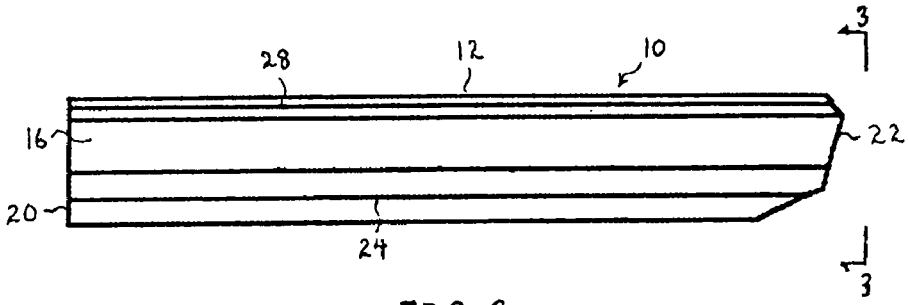
FIG. 2 is a side view of the breech bolt shown in FIG. 1.

Referring to FIG. 2, this view of bolt 10 shows side face 16, rib 24, and groove 28 as positioned vertically below the apex of top face 12. Front face 20 can be seen to be substantially flat, and rear face 22 is irregularly shaped as is familiar to those skilled in the art.

Figure 3:
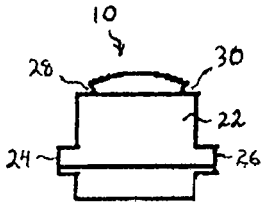
FIG. 3 is a view taken along line 3-3 in FIG. 2.

Referring to FIG. 3, this view of bolt 10 shows its rear face 22, and more clearly illustrates the dovetail configuration of grooves 28 and 30. The surfaces that define each groove preferably define about a 45° angle with respect to one another. Each of ribs 24 and 26 is also visible in FIG. 3.

Figure 4:
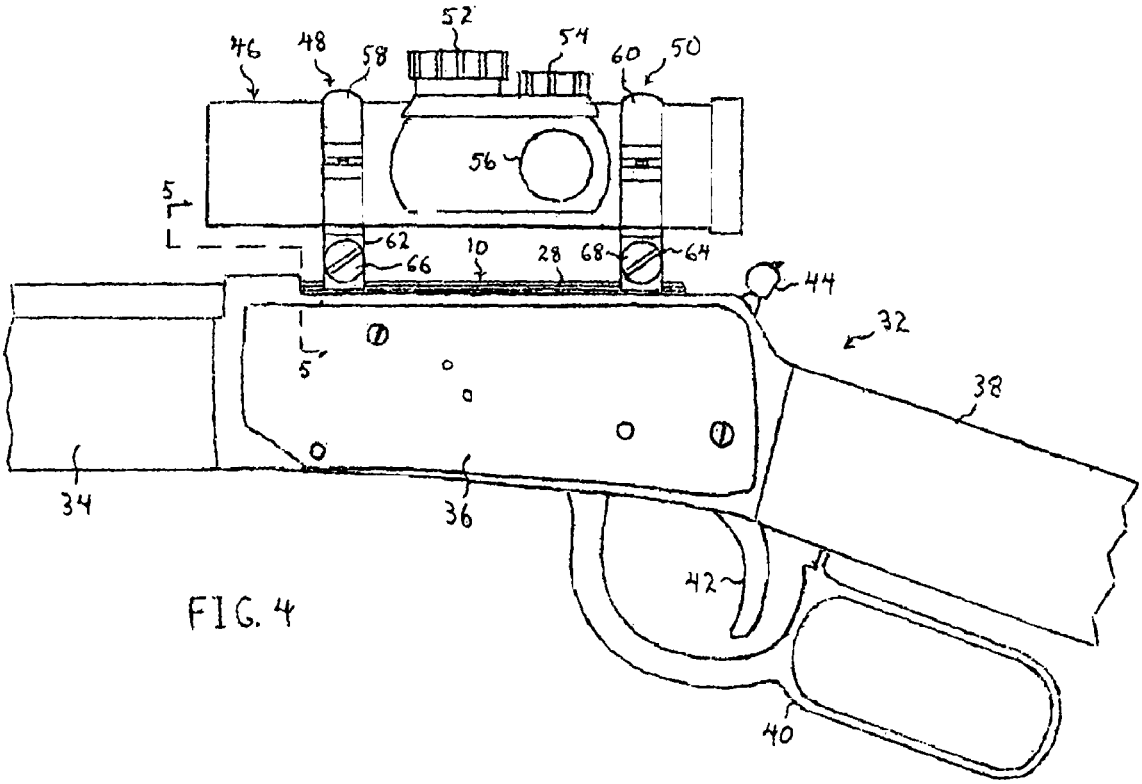
FIG. 4 is a fragmentary side view showing the previously illustrated breech bolt incorporated into a top ejection rifle with a sighting device mounted thereto. The breech bolt is shown in its closed position.

Referring to FIG. 4, the partially illustrated rifle 32 includes a magazine 34, an open-top receiver 36, a stock 38, a lever 40 depending from receiver 36 and extending rearwardly, a trigger 42, and a hammer 44. Such elements are conventional and need no further description. Bolt 10, as longitudinally slidable within receiver 36 between open and closed positions, is shown in FIG. 4 in its closed position with an upper portion thereof being exposed and having the above-mentioned grooves (of which only 28 is visible) to thereby allow a sighting device 46 to be fixedly but removably mounted to the bolt with a pair of scope mounts 48 and 50.

The sighting device 46 depicted in FIG. 4 is a "red dot" scope having various adjustment knobs, as indicated at 52, 54, and 56, for adjusting illumination, windage, and elevation. Bushnell is one manufacturer of this type of sighting device, which is relatively short insofar as being less than six inches in length. Such a length makes sighting device 46 particularly desirable for mounting to bolt 10 in accordance with the invention, as will become more clearly apparent in subsequent discussion. Scope mounts 48 and 50 include rings 58 and 60, respectively, for surrounding and securely holding the tubular body of sighting device 46, and further include respective mounting clamps 62 and 64, as is well known in the art. The mounting clamps of scope mounts 48 and 50 are preferably of the type designed for engaging grooves in the receiver of a .22 caliber rifle, and are consequently appropriately sized for engaging the grooves in bolt 10.

Figure 5:
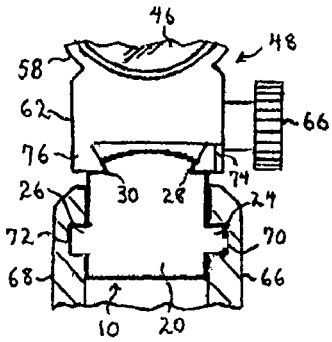
FIG. 5 is a view taken along line 5-5 in FIG. 4.

Referring to FIG. 5, this fragmentary view, as taken along line 5-5 in FIG. 4, shows front face 20 of bolt 10, as well as opposing sidewalls 66 and 68 of receiver 36 having corresponding longitudinal slots 70 and 72 for slidably and respectively receiving ribs 24 and 26 therein. A front portion of sighting device 46 is shown as being received in ring 58 of scope mount 48, and clamp members 74 and 76 of mounting clamp 62 can be seen to be securely received in and mated with respective dovetail grooves 28 and 30, as are positioned above but closely adjacent to sidewalls 66 and 68. In the particular scope mount illustrated, clamp member 74 has a portion thereof that is transversely adjustable by means of adjustment screw 66, thus allowing easy adjustment for either mounting to the bolt or removal therefrom. Of course, mounting clamp 64 of scope mount 50 (FIG. 4) is identical to mounting clamp 62 in its manner of engagement with the grooves of bolt 10.

Figure 6:
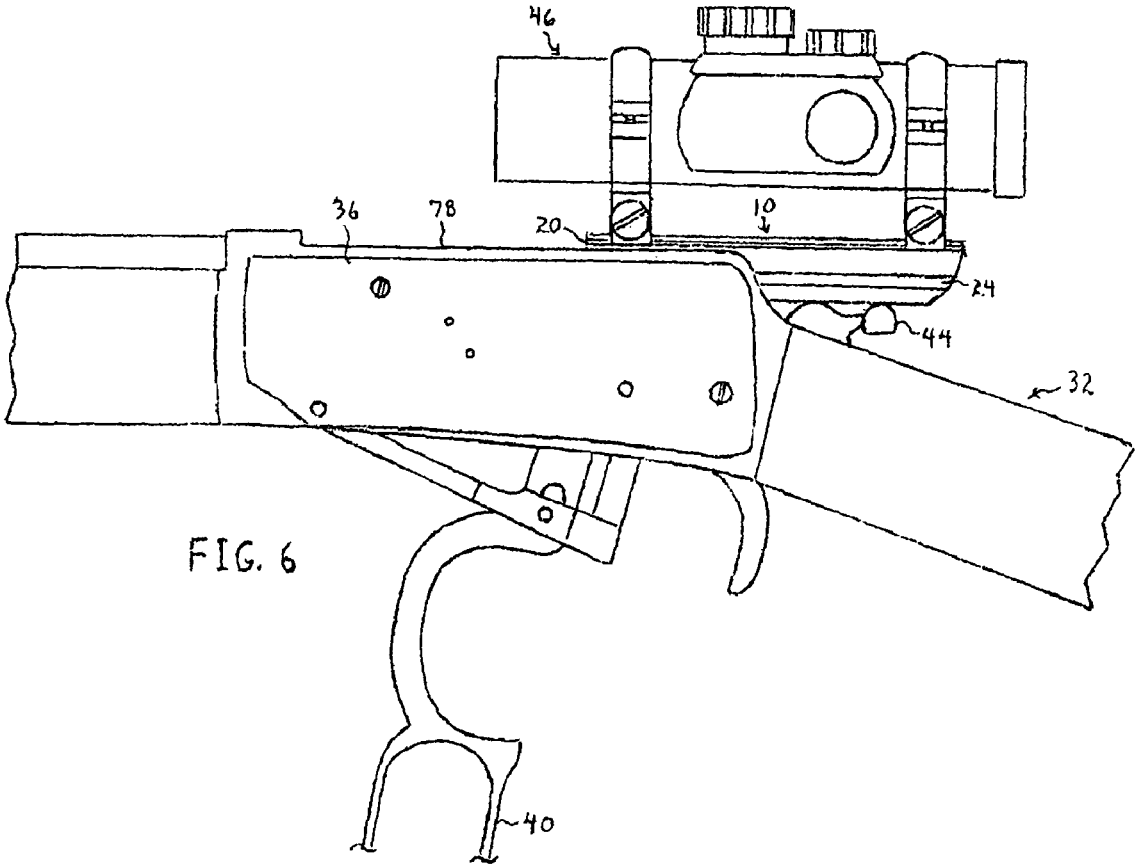
FIG. 6 is a view similar to FIG. 4, but showing the breech bolt in its open position.

Referring to FIG. 6, bolt 10 is shown in its fully open position after having moved rearwardly as a result of the manipulation of lever 40 to the illustrated corresponding position. In its open and maximally rearward position, not only the above-mentioned upper portion but also a substantial additional portion of bolt 10 is exposed. Hammer 44 is pivoted back and downwardly. As mounted to bolt 10, sighting device 46 has moved rearwardly with the bolt to that position indicated without any obstruction to or interference with the bolt's movement. Assuming a cartridge in rifle 32 has been fired, a spent shell casing (not shown) will have been ejected from the open top 78 of receiver 36 in the course of the rearward movement of bolt 10. Even though a front end portion of sighting device 46 longitudinally extends a short distance beyond front face 20 of bolt 10, the ejected shell casing would not have impacted the sighting device. This is because the manner of ejection from a Model 94 rifle causes the shell casing to follow a trajectory that includes not only upward, but also forward and rotational components. In other words, the shell casing exits open top 78 traveling both upwardly and forwardly, while at the same time beginning rotation in a clockwise direction so as to bring the front end (i.e. nose) up and the back end down. In general, it is preferred that the front end portion of sighting device 46 extends no more than about one inch beyond the longitudinal position of the bolt's front face in order to ensure that an ejected shell casing does not hit the sighting device.

Of course, it should be apparent that any sighting device that is sufficiently "short" to avoid impact by ejected shell casings is useable with the bolt of the invention. Most "red dot" and holographic sighting devices will work well with the invention. In addition, the means of mounting the sighting device to the bolt is only limited to those mounts which can securely but removably engage the grooves in the bolt. If a particular sighting device includes an integral mount (i.e. "weaver style") that is not compatible with the grooved bolt, adapters are commercially available that easily solve this problem.

Obviously, many modifications and variations of the present invention are possible in light of the above teachings. It is, therefore, to be understood that the invention can be practiced otherwise than as specifically described.

That which is claimed is:

1. In a top ejection firearm of the type having an open-top receiver with opposing sides, and also having an elongated, nonrotatable breech bolt longitudinally slidable in the receiver between open and closed positions in which an upper portion of the breech bolt is exposed, the upper portion of the breech bolt having a pair of longitudinally extending and transversely opposed grooves positioned above but closely adjacent to the opposing sides of the receiver, and wherein the breech bolt has a top face and opposing side faces, the pair of grooves longitudinally extending along said upper portion of the breech bolt where the top face joins the opposing side faces, whereby a sighting device may be removably mounted to the breech bolt with at least one mounting clamp securely but removably engaging the grooves.

2. In a top ejection firearm as recited in claim 1 wherein the grooves extend along substantially the entire length of the breech bolt.

3. In a top ejection firearm as recited in claim 1 wherein the grooves are dovetail grooves.

4. In a top ejection firearm as recited in claim 3 wherein the breech bolt has surfaces that define each groove, and wherein those surfaces which define a particular groove define about a 45° angle with respect to one another.

5. In a top ejection firearm of the type having an open-top receiver with opposing sides, a combination comprising: an elongated and nonrotatable breech bolt having an upper portion and being longitudinally slidable in the receiver between open and closed positions in which said upper portion is exposed, the upper portion of the breech bolt having a pair of longitudinally extending and transversely opposed grooves positioned above but closely adjacent to the opposing sides of the receiver; a sighting device; and at least one mounting clamp having a pair of clamp members secured but removably received in and mated with the respective grooves so as to fixedly but removably mount the sighting device to said upper portion of the breech bolt.

6. In a top ejection firearm as recited in claim 5 wherein the breech bolt has a top face and opposing side faces, the pair of grooves longitudinally extending along said upper portion of the breech bolt where the top face joins the opposing side faces.

7. In a top ejection firearm as recited in claim 6 wherein the grooves extend along substantially the entire length of the breech bolt.

8. In a top ejection firearm as recited in claim 5 wherein the grooves are dovetail grooves.

9. In a top ejection firearm as recited in claim 8 wherein the breech bolt has surfaces that define each groove, and wherein those surfaces which define a particular groove define about a 45° angle with respect to one another.

10. In a top ejection firearm as recited in claim 5 wherein the sighting device is less than about six inches in length.

11. In a top ejection firearm as recited in claim 10 wherein the breech bolt has a front face, and wherein the sighting device has a front end portion extending no more than about one inch beyond the breech bolt's front face.

* * * * *